US005842233A

United States Patent [19]

Brodén

[11] Patent Number: 5,842,233

[45] Date of Patent: Dec. 1, 1998

[54] URINE COLLECTING DEVICE

[76] Inventor: Bengt-Inge Brodén, Gårdfarivägen 3, S-352 00, Skara, Sweden

[21] Appl. No.: 750,970

[22] PCT Filed: Jun. 1, 1995

[86] PCT No.: PCT/SE95/00631

§ 371 Date: Dec. 2, 1996

§ 102(e) Date: Dec. 2, 1996

[87] PCT Pub. No.: WO95/33432

PCT Pub. Date: Dec. 14, 1995

[30] Foreign Application Priority Data

Jun. 2, 1994 [SE] Sweden ..... 9401910

[51] Int. Cl.[6] ..... A47K 11/00

[52] U.S. Cl. ..... 4/144.1

[58] Field of Search ..... 4/144.1–144.4; 604/317, 323, 326

[56] References Cited

U.S. PATENT DOCUMENTS

| | | | |
|---|---|---|---|
| 3,473,172 | 10/1969 | Friedman et al. | 4/144.3 |
| 3,781,922 | 1/1974 | Ericson | 604/317 X |
| 3,901,235 | 8/1975 | Patel et al. | 604/323 |
| 5,010,599 | 4/1991 | Nilsson | 4/144.3 X |

FOREIGN PATENT DOCUMENTS

| | | |
|---|---|---|
| 2936622 | 3/1981 | Germany . |
| 378356 | 9/1975 | Sweden . |
| 448672 | 3/1987 | Sweden . |
| 880359 | 3/1990 | Sweden . |

*Primary Examiner*—Charles E. Phillips
*Attorney, Agent, or Firm*—Sughrue, Mion, Zinn, Macpeak & Seas, PLLC

[57] ABSTRACT

A device for collecting urine or other organic body fluids includes a flexible bag (1) made of liquid-impervious sheet material, means (2) for receiving urine and conducting urine into the bag, and means for preventing urine from leaving the bag through the urine-receiving means. The urine-receiving means (2) is attached to a mounting flange (5) which is welded sealingly to the bag (1). The flange is provided with a bottom which lies at least partially loosely against the bag wall. The flange bottom includes openings through which urine can flow and that part of the bag wall located beneath the bottom is provided with at least one cut so as to form at least one flap. This flap allows urine to flow into the bag (1) through the openings in the flange bottom, but functions to close these openings when urine tends to flow in the reverse direction.

8 Claims, 2 Drawing Sheets

URINE COLLECTING DEVICE

The present invention relates to a device for collecting urine or other organic body fluids, comprising a flexible bag made of liquid impervious sheet material, means for receiving and conducting urine into the bag, and means for preventing urine from leaving the bag through the urine-receiving means.

A device of this kind eliminates, among other things, the various problems associated with the use of bottles and bedpans by patients confined to wheelchairs and beds. Furthermore, the device improve the hygiene of both patients and nursing personnel or minders, and many of the unpleasantnesses associated with the handling of bedpans can be eliminated, because the urine is handled while enclosed in a throw-away liquid-impervious plastic bag.

Urine-collecting devices of this kind can also be used by healthy people in many circumstances, for instance in automotive vehicles, boats and aircrafts.

U.S. Pat. No. 3,928,875 describes a urine-collecting device of this general kind. The manufacture of this known device, however, requires several working stages, among other things the fabrication of a separate valve housing with a loose float, therewith making manufacture relatively expensive.

The object of the present invention is to provide a urine-collecting device of the aforedefined kind which can be used by both men and women without the risk of spillage. The device shall also have a construction which enables the device to be manufactured in a very efficient manner and at low cost.

These objects are achieved in accordance with the invention by virtue of the coaction of a part of the wall of the bag with a mounting flange such as to obtain a check valve function.

An inventive urine-collecting device is characterized in that the urine-receiving means is attached to a mounting flange which is welded sealingly to the bag and which includes a bottom which lies at least partially loosely against the bag wall and which includes openings through which urine is able to pass; and in that the part of the bag wall which lies beneath said bottom has provided therein at least one cut such as to form at least one flap which while enabling urine to pass into the bag through the openings in said bottom, effectively closes these openings when urine tends to flow in the reverse direction.

A device of this kind can be readily manufactured since, among other things, it includes no separate valve housing and float, and can be fully automated.

According to one preferred embodiment of the invention, the bag wall has formed therein two flaps which are preferably generally semi-circular in shape and which face away from one another and are hingedly connected to an intermediate part of the bag material.

The urine-receiving device will conveniently be removably attached to the mounting flange, for instance through the medium of a bayonet fitting. This enables the urine-receiving device to be re-used after having first removed the urine-containing bag therefrom, whereafter the bag cab be discarded.

According to one preferred embodiment of the urine-collecting device, the bag has a generally rectangular shape and the urine-receiving device is mounted at one short side of the bag. A part of the bag on the side of the receiving device opposite to said short side is welded by means of a transverse weld which joins the bag walls together. This prevents the heavy flow of urine against the flap from the interior of the bag, said flag functioning as a check valve, which further reduces the risk of urine leaking from the device.

The weld join will conveniently extend over a central part of the bag, such as to leave free urine passageways along both edge sides of the bag. The flaps are cut out of the bag wall such that one of said flaps is opened against the transverse weld join, meaning that urine is unable to flow directly towards the flap opening.

Other features of the invention will be apparent from the following claims.

The invention will now be described in more detail with reference to an exemplifying embodiment thereof and also with reference to the accompanying drawings.

Figure 1:
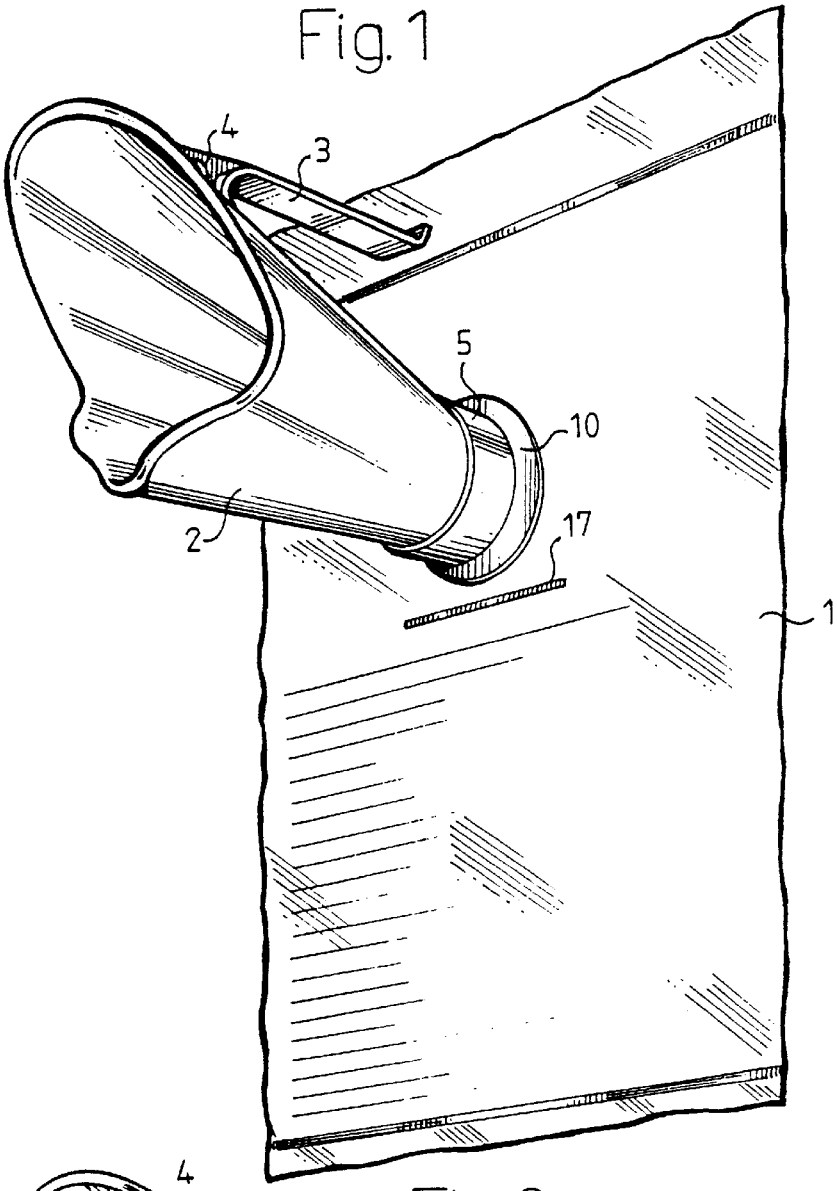
FIG. 1 is a perspective view of an inventive device.

The urine-collecting device shown in FIG. 1 includes a bag 1 comprised of liquid-impervious plastic sheet which has been folded appropriately and welded together. A funnel-shaped urine-receiving means 2 which functions to receive and conduct urine into the bag is fitted to one short side of the generally rectangular bag 1. This facilitates use of the bag even by bed-ridden patients. The outer contour line of the funnel is precisely configured to permit tight abutment with the skin when used by women. The front part of the funnel includes a handle 3, which facilitates pressing of the funnel against the skin of the user, to this end. The upper part of the handle 3 includes a hole 4 by means of which a used bag can be hung on hook, located for instance adjacent the patient's bed.

Figure 2:
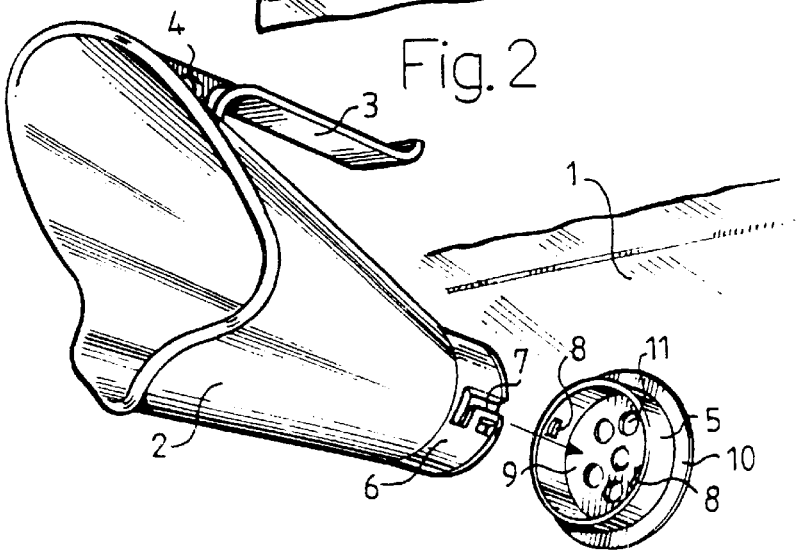
FIG. 2 illustrates fitting of the urine-receiving means to the urine-collecting bag.
Figure 6:
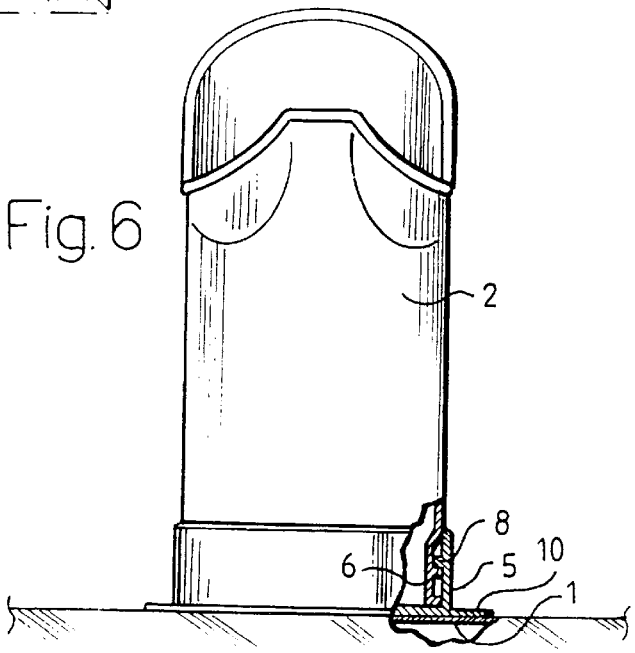
FIG. 6 is a side view of the device shown in FIG. 1, partially in section.

As shown in FIG. 2, the funnel 2 is fitted to the bag 1 with the aid of a mounting flange 5 welded to the bag. The bottom part 6 of the funnel includes two angled slots 7 which coact with corresponding projections 8 on the mounting flange to provide a bayonet lock by means of which the funnel can be secured to the flange. When fitting the funnel to the mounting flange, the bottom part 6 is therewith inserted into the flange 5 and the slots 7 and projections 8 brought into mutual coaction. The essentially horizontal parts of the slots 7 may be inclined to some extent, so that the funnel 2 will be pressed down when twisting the funnel so as to lock the funnel on the mounting flange. This results in an effective seal between the bottom edge surface of the part 6 and a bottom plate 9 provided in the flange 5; see also FIG. 6. With the intention of ensuring that the funnel will always be correctly positioned on the bag when fitted, the slots 7 on the lower part of the funnel may be given slightly different widths and arranged to coact with projections 8 of slightly different widths on the inner surface of the flange 5; see FIG. 4.

The mounting flange 5 is welded sealingly at the upper wall of the bag 1 through the medium of a circumferentially extending collar 10. The bottom plate 9 of the flange 5, on the other hand, lies loosely against the bag wall, and is provided with a number of openings 11 for the through-passage of urine.

Figure 3:
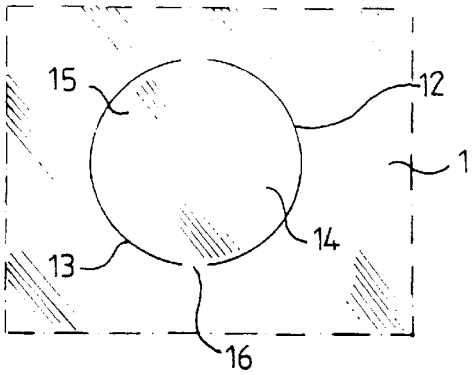
FIG. 3 shows part of a bag wall provided with flaps.
Figure 4:
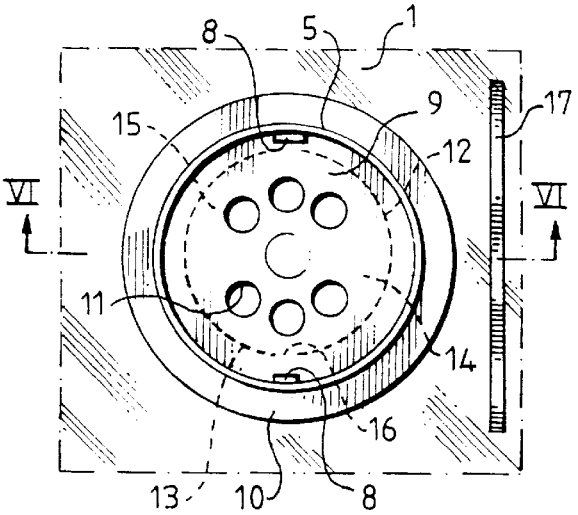
FIG. 4 illustrates part of the bag with a mounting flange fixedly welded thereto.

As will be seen from FIGS. 3 and 4, that part of the upper wall of the bag 1 which is located beneath the bottom plate 9 has provided therein two generally semi-circular cuts 12, 13 which form two flaps 14 and 15 in the bag material, these flaps being hinged together by an intermediate part 16 of the bag wall. As will be seen form FIG. 4, each flap is located beneath a series of openings 11 in the bottom plate 9 of the mounting flange 5, and is effective in preventing urine from running back through said openings.

Figure 5:
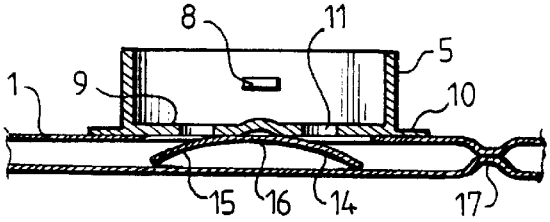
FIG. 5 is a sectional view taken on the line VI—VI in FIG. 4.

FIG. 5 is a sectional view which shows the positions of the flaps 4 and 15 when urine received in the funnel 2 flows down into the bag 1. The reference numeral 17 in FIGS. 1, 4 and 5 identifies a weld which joins together the two walls of the bag 1 across a part located centrally of the mounting flange 5. This weld prevents urine from flowing heavily from the bottom part of the bag directly towards the opening defined by the flap 14. Instead, the urine will flow in towards the flaps from the side on which the flaps are joined to the upper wall of the bag by the part 16. The flats are therewith pressed sealingly against the perforated bottom plate 9 of the mounting flange 5 and close the openings. The flaps thus function as effective check valves.

When using an inventive urine-collecting device, urine is received in the funnel 2 and runs down into the bag 1 while flexing away the flaps 14 and 15 formed in the thin bag-material, as illustrated in FIG. 5. In the event of urine flowing back from the bag, the flaps are again swung up into contact with the plate and therewith close the openings 11, so that no urine is able to leave the bag.

When the bag has been filled with urine, for instance after having been used once or twice, the funnel 2 is disconnected from the bag, which can be effected easily. The bag may be provided with a tear line, to facilitate emptying of the bag. The bag is then discarded. All of the surfaces of the funnel 2 are smooth, so that the funnel can be easily cleaned and fitted to a new bag with a simple movement of the hand. Flaps that have mutually different degrees of flexibility can be provided, by varying the length of the cuts which form the flaps. The device may alternatively include only one single flap, in which case the flap opening is conveniently positioned towards the transverse weld 17. Another alternative is to punch a plurality of smaller flaps of any desired shape in the bag wall.

The device may also be modified in several other respects, for instance with regard to the number of openings 11. The positioning of the openings 11 may also be chosen in accordance with requirements. Similarly, the funnel may be secured to the mounting flange with the aid of means different to those shown. The funnel 5 may also be given any desired shape or replaced with some other urine-receiving means, for instance in the form of a compressible cylindrical part which can be compressed in the direction of its long axis or folded down towards the bag, to provide a small package which can be easily carried along or made available in different circumstances.

I claim:

1. A device for collecting urine or other organic body fluids, comprising flexible bag (1) made of liquid-impervious sheet material, means (2) for receiving urine and conducting urine into the bag, and means (14, 15) for preventing urine from leaving the bag through said urine-receiving means, wherein the urine-receiving means is attached to a mounting flange (5) which is welded sealingly to the bag and which is provided with a bottom (9) which lies at least partially loosely against the bag wall and which includes openings (11) for the through-passage of urine; the wall part of the bag located beneath said bottom has provided therein at least one cut (12, 13) to form at least one flap (14, 15) which while enabling urine to pass into the bag through the openings provided in the bottom functions to close these openings when urine tends to flow back in the reverse direction the bag has a generally rectangular shape; the urine-receiving means is mounted at one short side of the bag; a part of said bag on the side of the urine-receiving means opposite to said short side is welded by means of a transverse weld (17) which joins the bag walls together, and the weld extends across a central part of the bag, so as to leave free passages along both side edges of the bag.

2. A device for collecting urine or other organic body fluids, comprising a flexible bag (1) made of liquid-impervious sheet material, means (2) for receiving urine and conducting urine into the bag, and means (14, 15) for preventing urine from leaving the bag through said urine-receiving means, wherein the urine-receiving means is attached to a mounting flange (5) which is welded sealingly to the bag and which is provided with a bottom (9) which lies at least partially loosely against the bag wall and which includes openings (11) for the through-passage of urine; the wall part of the bag located beneath said bottom has provided therein at least one cut (12, 13) to form at least one flap (14, 15) which while enabling urine to pass into the bag through the openings provided in the bottom functions to close these openings when urine tends to flow back in the reverse direction, the bag has a generally rectangular shape; the urine-receiving means is mounted at one short side of the bag; a part of said bag on the side of the urine-receiving means opposite to said short side is welded by means of a reverse weld (17) which joins the bag walls together, and one of said flaps in the bag wall opens towards said transverse weld.

3. A collecting device according to claims 1 or 2 wherein, the bag wall has formed therein two flaps (14, 15) which face away from one another and which are hingedly connected by an intermediate wall part (16).

4. A collecting device according to claim 3, wherein the two flaps (14, 15) are essentially semi-circular in shape.

5. A collecting device according to claim 3, wherein the openings in the bottom (9) have the form of a series of holes (11) above each flap (14, 15).

6. A collecting device according to claims 1 or 2, wherein the urine-receiving means (2) is removably attached to the mounting flange (5).

7. A collecting device according to claim 6, wherein the urine-receiving means (2) includes a part (6) which can be inserted into the mounting flange (5) and locked therein by means of a bayonet fitting (7, 8).

8. A collecting device according to claims 1 or 2, wherein the flap (14, 15) is formed in the bag wall with the aid of an arcuate cut (12, 13).

* * * * *